United States Patent [19]

Stoltman

[11] 4,321,902

[45] Mar. 30, 1982

[54] ENGINE CONTROL METHOD

[75] Inventor: Donald D. Stoltman, Henrietta, N.Y.

[73] Assignee: General Motors Corporation, Detroit, Mich.

[21] Appl. No.: 139,429

[22] Filed: Apr. 11, 1980

[51] Int. Cl.[3] ..... F02M 7/00; F02M 51/00

[52] U.S. Cl. ..... 123/435; 123/438; 123/491; 123/179 G; 123/486; 261/52; 261/39 R

[58] Field of Search ..... 123/425, 435, 491, 179 G, 123/179 L, 480, 486, 438–439; 261/52, 39 R

[56] References Cited

U.S. PATENT DOCUMENTS

| | | | |
|---|---|---|---|
| 1,577,766 | 3/1926 | Sisson . | |
| 2,225,943 | 12/1940 | Schweiss | 123/179 G |
| 2,407,652 | 9/1946 | Costa | 123/425 |
| 2,458,086 | 1/1949 | MacMillan | 123/425 |
| 2,470,709 | 5/1949 | MacMillian | 123/425 |
| 2,684,057 | 7/1954 | Bolton | 123/179 G |
| 3,172,251 | 3/1965 | Johnson | 60/425 |
| 3,534,720 | 10/1970 | DuBois | 123/179 G |
| 3,807,172 | 4/1974 | Masaki | 123/425 |
| 3,948,240 | 4/1976 | Hirosawa et al. | 123/179 G |
| 3,977,373 | 8/1976 | Sand | 123/425 |
| 3,978,835 | 9/1976 | Fenton | 123/425 |
| 4,011,844 | 3/1977 | Hirosawa et al. | 123/425 |
| 4,033,712 | 7/1977 | Morton | 431/90 |
| 4,075,993 | 2/1978 | Bertling | 123/425 |
| 4,083,342 | 4/1978 | Bertling | 123/589 |
| 4,181,944 | 1/1980 | Yamauchi et al. | 123/425 |
| 4,211,194 | 7/1980 | Hattori et al. | 123/425 |

FOREIGN PATENT DOCUMENTS

| | | |
|---|---|---|
| 2819809 | 11/1978 | Fed. Rep. of Germany . |
| 39842 | 12/1977 | France . |

OTHER PUBLICATIONS

J. D. Powell and M. Hubbard, "Closed-Loop Control of Spark Timing", Sections 2 and 4, (pp. 174 and 184). Automotive Engineering, 10–1978, pp. 88–91.

*Primary Examiner*—Charles J. Myhre
*Assistant Examiner*—E. Rollins Cross
*Attorney, Agent, or Firm*—C. K. Veenstra

[57] ABSTRACT

During operation of an internal combustion engine at low temperatures, the carburetor choke is closed to the extent necessary to provide the fuel which will maintain the mean effective pressure of combustion equal to the mean effective pressure occurring during operation at normal temperatures. The torque produced during low temperature engine operation is thus maintained equal to the torque produced during operation at normal temperatures.

2 Claims, 1 Drawing Figure

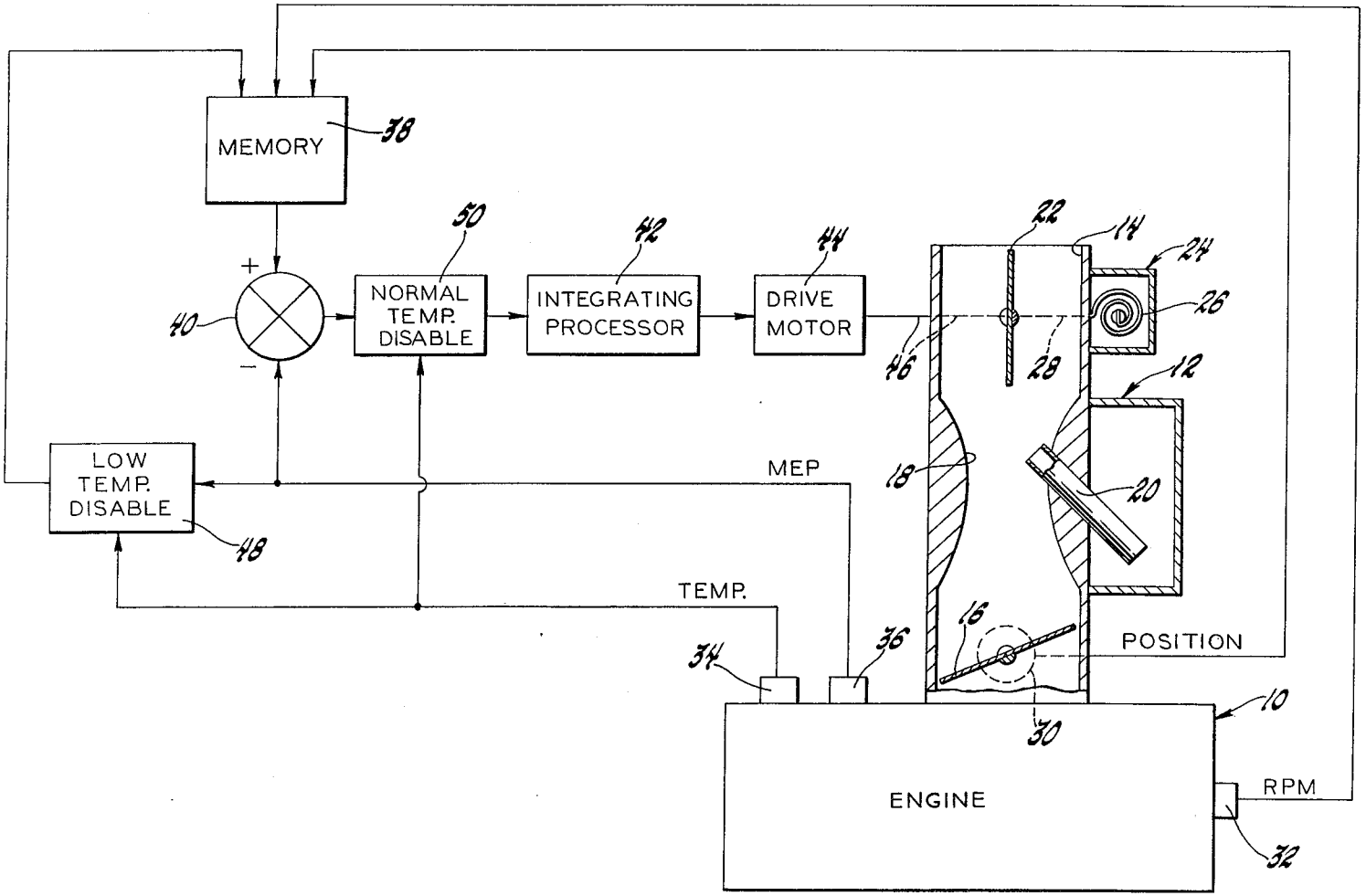
RPM
32
10
POSITION
24
26
12
14
20
22
28
30
16
18
46
36
ENGINE
44
DRIVE MOTOR
MEP
TEMP.
34
42
INTEGRATING PROCESSOR
50
NORMAL TEMP. DISABLE
38
MEMORY
+
−
40
48
LOW TEMP. DISABLE

ENGINE CONTROL METHOD

TECHNICAL FIELD

This invention relates to a method for providing fuel to an engine to produce the engine torque desired during low temperature engine operation.

BACKGROUND

Internal combustion engines, such as those used in automotive vehicles, conventionally include a fuel system which provides fuel to the engine at a rate that varies with one or more operating conditions such as the rate of air flow to the engine or a combination of engine speed and load. At each engine operating point, during operation at normal temperatures, the fuel flow is carefully controlled to produce the desired engine torque.

During operation at less than normal temperatures, however, that same fuel flow is insufficient to produce the torque desired for the particular engine operating point. Accordingly, such engines also conventionally include a choke or other cold enrichment mechanism to increase fuel flow and thus enrich the air-fuel mixture during low temperature operation. A sufficiently enriched air-fuel mixture would assure that the engine would produce adequate torque during the warm-up period before it reaches normal operating temperature.

It has been recognized, however, that an enriched air-fuel mixture increases fuel consumption and contributes to emissions of hydrocarbons and carbon monoxide in the engine exhaust gases. To minimize those effects, the prior cold enrichment mechanisms schedule the amount of enrichment with time, engine temperature, and other engine operating conditions. Yet any such schedule is only an approximation of the cold enrichment actually required: When the cold enrichment schedule falls short of the required amount, the engine will produce insufficient torque; when the cold enrichment schedule exceeds the required amount, the engine will consume unnecessary fuel and create unnecessary exhaust emissions.

SUMMARY OF THE INVENTION

This invention provides a method for providing fuel to an engine to assure that it will produce the desired torque during low temperature engine operation without unnecessary fuel consumption of exhaust emissions.

Stated generally, this invention proposes that the torque desired for various low temperature engine operating points be established, that the torque actually produced at such points be measured, and that the fuel flow be adjusted as necessary to maintain the torque actually produced at such points substantially equal to the torque desired for such points. Thus this invention may be considered to provide a closed loop control system in which the torque desired for various low temperature operating conditions is established and fuel flow is controlled to produce the desired torque.

More particularly, it is suggested that the torque actually produced at particular operating points during engine operation at normal temperatures be established as the torque desired for such operating points during low temperature operation. Then in an engine according to this invention, a parameter such as the mean effective pressure of combustion is measured as an indication of the torque produced by the engine. A memory records values of the parameter which occur at particular operating points during operation at normal temperatures. During subsequent low temperature operation, fuel flow is adjusted as necessary to maintain the measured values of the parameter substantially equal to the values recorded for those operating points.

Accordingly, in its preferred embodiment, this invention contemplates a system including a nonvolatile memory addressable by an engine operating condition such as the rate of induction air flow or a combination of engine speed and load. The mean effective pressure of combustion in the engine at each engine operating point during operation at normal temperatures is recorded at the corresponding address in the memory and establishes the mean effective pressure of combustion corresponding to the torque desired for that operating point during low temperature operation. Then the next time the engine is started, a motor positions the choke to adjust the fuel flow so as to maintain the measured mean effective pressure at each operating point substantially equal to the mean effective pressure recorded in the memory for that operating point.

This invention thereby assures that the torque produced during low temperature operation is substantially equal to the torque produced during operation at normal temperatures and yet unnecessary fuel consumption and exhaust emissions are avoided.

The details as well as other features and advantages of this invention are set forth in the remainder of the specification and are shown in the accompanying drawing.

SUMMARY OF THE DRAWING

The sole FIGURE of the drawing is a schematic view of an engine having apparatus for closing its choke to provide the fuel which will maintain the mean effective pressure of combustion in the engine during low temperature engine operation substantially equal to the mean effective pressure of combustion occurring during operation at normal temperatures.

BEST MODE FOR CARRYING OUT THE INVENTION

Referring to the drawing, an engine 10 has a carburetor 12 forming a portion of an induction passage 14 that supplies combustion air to engine 10. Induction passage 14 includes a throttle 16 to control the rate of air flow therethrough and a venturi 18 to create a vacuum signal which varies with the rate of air flow through induction passage 14. A fuel supply passage 20 delivers fuel to venturi 18 at a rate which varies with the venturi vacuum signal so that fuel is mixed in a desired ratio with the air flowing through induction passage 14 to engine 10.

A choke 22 is also disposed in induction passage 14. As choke 22 is moved from the wide open or lean position shown in the drawing, the pressure in venturi 18 is decreased (the venturi vacuum signal is increased) to increase fuel flow through fuel supply passage 20 and thus create an enriched air-fuel mixture in induction passage 14. Choke 22 may be positioned by a conventional automatic cold enrichment choke mechanism 24 which includes a coiled bi-metal thermostat 26 that is connected by a link 28 to choke 22; thermostat 26 biases choke 22 toward a closed or rich position with a force inversely proportional to temperature. Thus before engine 10 is started, choke mechanism 24 tends to hold choke 22 in a closed or rich position. During the warm-up period, choke mechanism 24 may allow choke 22 to open gradually until it reaches the lean position illustrated, or choke mechanism 24 may include provision for rapidly or immediately pulling choke 22 to the lean position illustrated promptly after engine 10 is started. Choke 22 accordingly creates a very rich mixture for starting engine 10 and then gradually or quickly reduces the enrichment.

A sensor 30 measures the position of throttle 16, a sensor 32 measures the speed of engine 10, a sensor 34 measures the temperature of the engine coolant, and a sensor 36 measures the mean effective pressure of combustion in engine 10. Each of sensors 30, 32, 34 and 36 may be of any well known construction, but it is noted that sensor 36 preferably comprises a quartz load cell retained beneath a cylinder head bolt on engine 10. Further, it will be appreciated that sensor 30 may measure vacuum or absolute pressure in induction passage 14 downstream of throttle 16 as an alternative to the position of throttle 16 since all three are recognized indicators of engine load.

The indications of engine load and speed provided by sensors 30 and 32 provide a meausre of air flow through induction passage 14. During engine operation at normal temperatures—that is, when the coolant has reached a temperature of about 100° C.—the values of mean effective pressure provided by sensor 36 are recorded in a nonvolatile memory 38 for each of several particular throttle positions and engine speeds and thus for each of several particular rates of air flow through induction passage 14. Thereafter, during engine operation at coolant temperatures less than 100° C. a comparator 40 compares the value of the mean effective pressure measured by sensor 36 at the then existing throttle position and engine speed with the corresponding value recorded in memory 38. If the mean effective pressure measured by sensor 36 is less than the recorded value, an error signal is created by comparator 40 and processed by an integrating processor 42 to energize a motor 44 which is connected by a link 46 to choke 22. Motor 44 then drives choke 22 toward a closed position to effect increased fuel flow through fuel supply passage 20. The fuel flow is accordingly increased by whatever amount is necessary to maintain the torque produced by engine 10 during low temperature operation at a particular rate of induction air flow substantially equal to the torque produced during normal engine operation at that rate of air flow.

Motor 44 has been described only as effective to drive choke 22 toward a closed position when the value of mean effective pressure measured by sensor 36 is less than the value recorded in memory 38. In some applications, however, choke enrichment mechanism 24 may set choke 22 in a position providing more enrichment than is required to produce the desired torque. In those applications, motor 44 may also drive choke 22 toward the lean position to effect a reduction in fuel flow when the value of mean effective pressure measured by sensor 36 is greater than the recorded value.

A disabling control 48 is included to prevent recording of values of mean effective pressure in memory 38 when the engine is operating at less than normal temperatures; the values of mean effective pressure recorded in memory 38 thus are updated only when engine 10 is operating at normal temperatures.

Similarly, a disabling control 50 is included to prevent energization of motor 44 and thus preclude closed loop control of torque through choke 22 once the engine reaches a normal operating temperature of about 100° C.

Moreover, it will be appreciated that fuel flow may be controlled to effect closed loop control of torque in accordance with this invention while using other fuel metering mechanisms in place of choke 22 and its associated systems.

The embodiments of the invention in which an exclusive property or privilege is claimed are defined as follows:

1. The method of operating a combustion engine having a fuel supply passage and means for measuring a parameter indicative of the engine torque, said method comprising the steps of:

during engine operation at normal temperatures—recording the values of the parameter indicative of the engine torque produced for particular operating points, and during engine operation at less than normal temperatures—providing the fuel flow through said fuel supply passage necessary to maintain the measured value of said parameter for each such operating point substantially equal to the recorded value for such operating point, whereby the torque produced during engine operation at less than normal temperatures is maintained substantially equal to the torque produced during engine operation at normal temperatures.

2. The method of operating a combustion engine having an air induction passage, a fuel supply passage, a choke movable from a lean position to effect increased fuel flow through said supply passage, and means for measuring the mean effective pressure of combustion in said engine, said method comprising the steps of:

during engine operation at normal temperatures—recording the values of the mean effective pressure of combustion for particular rates of air flow through said induction passage, and during engine operation at less than normal temperatures—moving said choke from its lean position to the extent necessary to maintain the measured value of the mean effective pressure of combustion for each said rate of air flow substantially equal to the recorded value for such rate of air flow, whereby fuel flow is increased to the extent necessary to maintain the torque produced during engine operation at less than normal temperatures substantially equal to the torque produced during engine operation at normal temperatures.

* * * * *